US011311440B2

(12) United States Patent
Yokota

(10) Patent No.: US 11,311,440 B2
(45) Date of Patent: Apr. 26, 2022

(54) CARING LIFT

(71) Applicant: Osamu Yokota, Fukuoka (JP)

(72) Inventor: Osamu Yokota, Fukuoka (JP)

( * ) Notice: Subject to any disclaimer, the term of this patent is extended or adjusted under 35 U.S.C. 154(b) by 205 days.

(21) Appl. No.: 16/620,352

(22) PCT Filed: Dec. 25, 2018

(86) PCT No.: PCT/JP2018/047464
§ 371 (c)(1),
(2) Date: Dec. 6, 2019

(87) PCT Pub. No.: WO2019/176224
PCT Pub. Date: Sep. 19, 2019

(65) Prior Publication Data

US 2020/0206052 A1 Jul. 2, 2020

(30) Foreign Application Priority Data

Mar. 14, 2018 (JP) ..... JP2018-071927

(51) Int. Cl.
*A61G 7/10* (2006.01)
*A61H 3/00* (2006.01)
*B66C 11/16* (2006.01)
*B66C 11/00* (2006.01)

(52) U.S. Cl.
CPC ..... *A61G 7/1001* (2013.01); *A61G 7/10* (2013.01); *A61G 7/1015* (2013.01);
(Continued)

(58) Field of Classification Search
CPC .. A61G 7/1001; A61G 7/1013; A61G 7/1015; A61G 7/1019; A61G 7/1038;
(Continued)

(56) References Cited

U.S. PATENT DOCUMENTS 4,372,452 A * 2/1983 McCord ..... A61G 7/1015 105/153
5,158,188 A * 10/1992 Nordberg ..... A61G 7/1015 212/312

(Continued)

FOREIGN PATENT DOCUMENTS

GB 2275604 * 3/1993 ..... A61G 7/1015
JP H05-40283 U 5/1993

(Continued)

*Primary Examiner* — David R Hare
*Assistant Examiner* — Madison Emanski
(74) *Attorney, Agent, or Firm* — Carrier Blackman & Associates, P.C.; William D. Blackman; Joseph P. Carrier

(57) ABSTRACT

A stationary type caring lift includes a base plate arranged on a floor part at each of head and foot sides of a bed for a care receiver along each short-side side of the bed, four supports erected on the base plates in the vicinity of four corners of the bed, a pair of guide rails supported above the bed by the four supports and arranged in parallel along both long-side sides of the bed, a longitudinally moving body arranged between the guide rails and capable of being moved in a longitudinal direction of the bed while being guided by the guide rails, a slide rail attached movably, a laterally moving body attached movably in the lateral direction of the bed, and a lifting drive mechanism attached in the laterally moving body for hanging down the care receiver and having a worm reduction gear with a self-lock function.

7 Claims, 14 Drawing Sheets

(52) U.S. Cl.
CPC ..... *A61G 7/1019* (2013.01); *A61G 7/1032* (2013.01); *A61G 7/1034* (2013.01); *A61G 7/1042* (2013.01); *A61G 7/1044* (2013.01); *B66C 11/00* (2013.01); *B66C 11/16* (2013.01); *A61H 3/00* (2013.01); *A61H 3/008* (2013.01)

(58) Field of Classification Search
CPC .. A61G 7/1042; A61G 7/1044; A61G 7/1007; A61G 7/10; A61G 7/1032; A61G 7/1055; A61G 7/1057; A61G 7/1071; A61G 3/0825; A61G 7/104; A61G 7/1025; A61G 7/1076; A61G 7/1049; A61H 3/00; A61H 3/008; A61H 1/0229; B66C 11/16; B66C 11/00; A47C 17/84; A47C 19/207; A47C 20/18; A47C 19/20; A47C 17/50
See application file for complete search history.

(56) References Cited

U.S. PATENT DOCUMENTS 5,539,941 A * 7/1996 Fuller ..... A61G 7/0005 5/85.1
7,462,138 B2 * 12/2008 Shetty ..... A61H 3/008 482/51
8,978,905 B2 * 3/2015 Bergenstråle et al. ..... A61G 7/1042 212/324
2001/0027149 A1 * 10/2001 Bingham ..... A61H 3/008 482/69
2008/0201843 A1 * 8/2008 Bendele ..... A61G 7/1042 5/83.1
2012/0110731 A1 * 5/2012 Hand ..... A61G 7/1015 5/87.1

FOREIGN PATENT DOCUMENTS

| | | | |
|---|---|---|---|
| JP | H06-209970 | A | 8/1994 |
| JP | H06-343666 | A | 12/1994 |
| JP | 3048148 | U | 5/1998 |
| JP | 2000-350750 | A | 12/2000 |
| JP | 2001-061906 | A | 3/2001 |
| JP | 2001-327553 | A | 11/2001 |
| JP | 2002-336308 | A | 11/2002 |
| JP | 2003-033408 | A | 2/2003 |
| JP | 2013-121475 | A | 6/2013 |
| JP | 2015-100480 | A | 6/2015 |
| WO | 2018/096479 | A1 | 5/2018 |

* cited by examiner

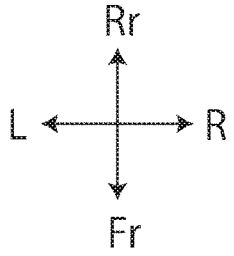
FIG. 8
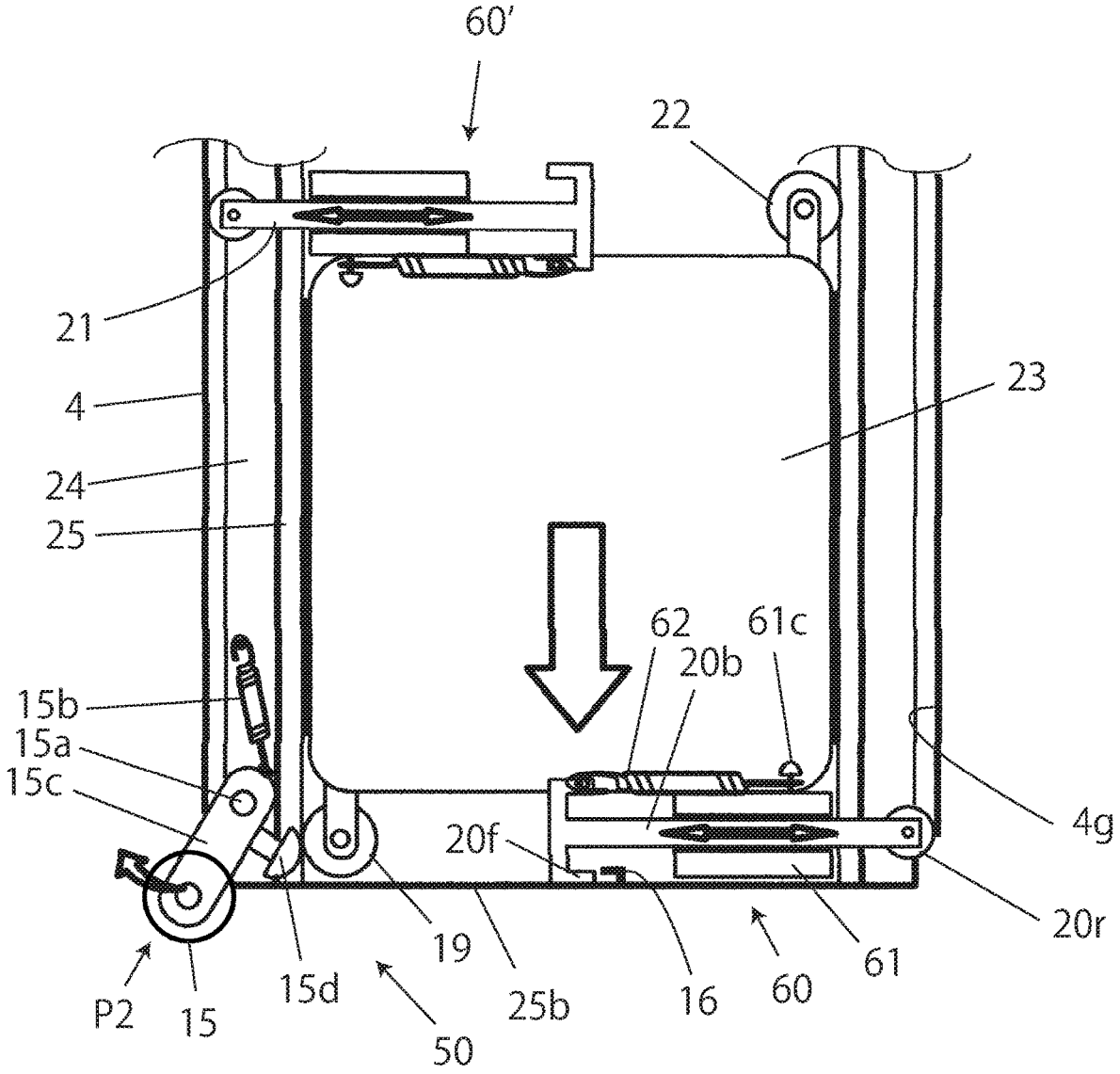

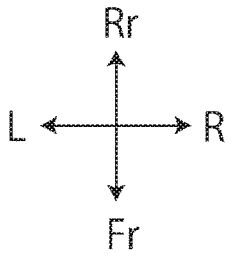
FIG. 9
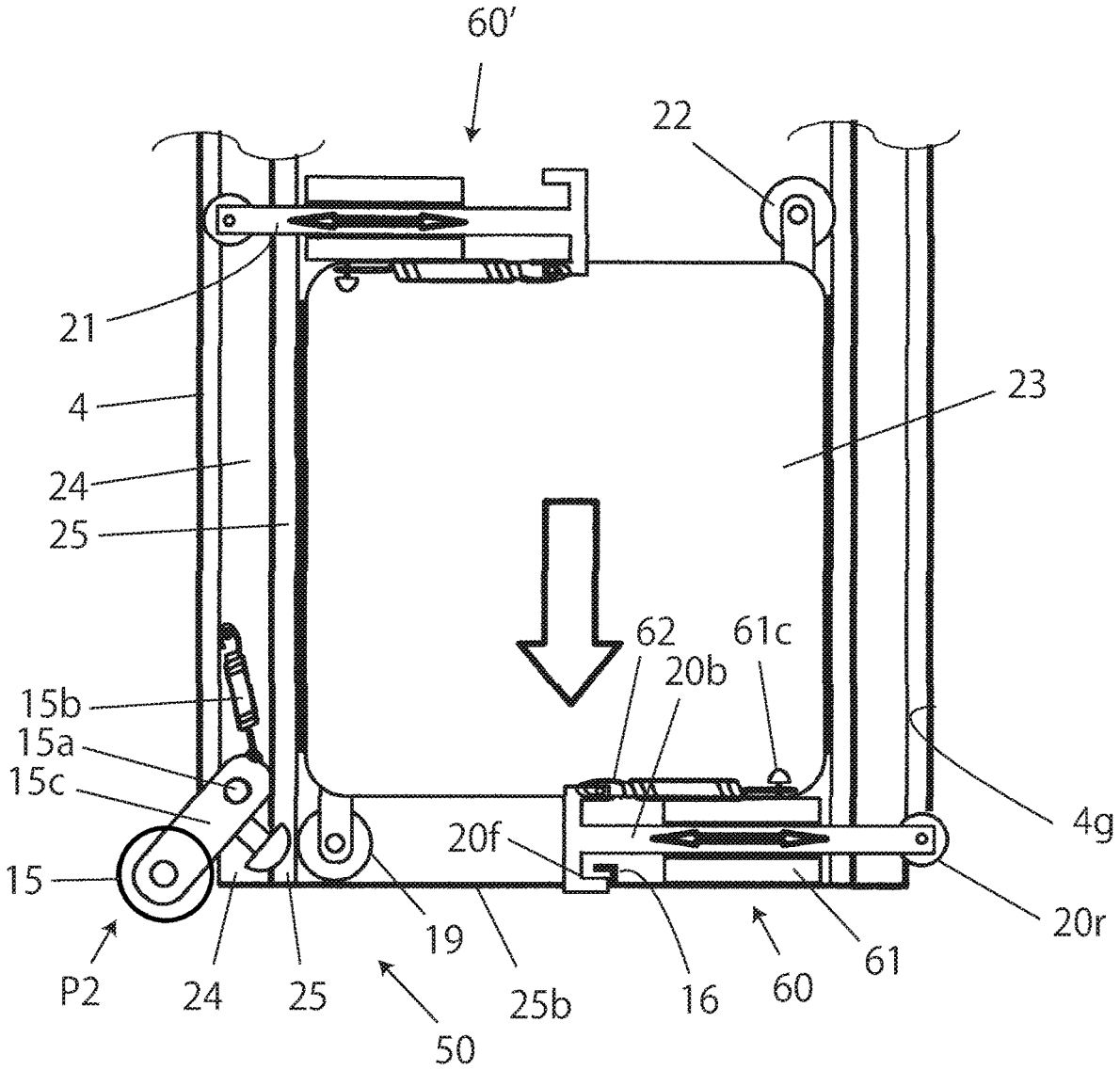

(a)

(b)

(a)

(b)

(c)

CARING LIFT

TECHNICAL FIELD

This invention relates to a stationary type caring lift.

BACKGROUND ARTS

As shown in FIG. 1 in a patent document 1, for instance, it is conventionally known that there is a stationary type caring lift including four supports 1, a pair of Y-directional guide rails 2, 2 supported above a bed (not shown) by the four supports 1 and arranged in parallel in a Y direction in planar view, a Y-directional moving body 3 arranged between the pair of Y-directional guide rails 2, 2 and capable of being moved in the Y direction while being guided by the Y-directional guide rails 2, 2, and a lifting drive mechanism 5 attached movably in a X direction relative to the Y-directional moving body 3 and moved between the Y-directional guide rails 2, 2 for hanging down a care receiver (not shown).

The stationary type caring lift of this kind is used to move the care receiver from on the bed to an outside of the bed or from the outside of the bed onto the bed while hanging down the care receiver with the lifting drive mechanism 5. Accordingly, when the stationary type caring lift disclosed in the patent document 1 is installed around the bed, more specifically, when the Y-directional guide rails 2, 2 are arranged to face a longitudinal direction of the bed, for instance, at least one guide rail 2 would be placed at a position largely away from the bed in planar view for securement of a X-directional moving area of the lifting drive mechanism 5.

Namely, frame bodies (2, 2, 8, 8) for securement of the moving area of the lifting drive mechanism 5 are in a state of protruding largely outward from the bed in planar view, and as a result, an increase in size and introduction cost of the stationary type caring lift would be caused.

A patent document 2 discloses a stationary type caring lift, wherein X- and Y-directional moving areas of a lifting drive mechanism 3 above a bed 6 are secured by a frame body (A), as shown in FIGS. 1 and 6 therein.

However, even in the stationary type caring lift disclosed in the patent document 2, the frame body (A) for securement of the moving areas of the lifting drive mechanism 3 is also in a state of protruding largely outward from the bed in planar view, resulting in an increase in size and introduction cost of the stationary type caring lift.

A stationary type caring lift disclosed in each of patent documents 3, 4 and 5 involves a problem similar to the above.

For the stationary type caring lift disclosed in the patent document 3, a beam 4 protrudes largely outward from a bed as shown in FIG. 1 therein.

For the stationary type caring lift disclosed in the patent document 4, a guide frame 4 protrudes largely outward from a bed 1 as shown in FIG. 1 therein.

For the stationary type caring lift disclosed in the patent document 5, a rail 3 protrudes largely outward from a bed 7 as shown in FIG. 1 therein.

It is noted that as disclosed in a patent document 6, for instance, it is also conventionally known that there is a caring lift having a moving type support structure body, wherein one support 13*a* out of supports 13*a*, 13*b* of a moving type support structure body 12 is mounted on a floor-installation type base 16 which is to be arranged outside of a longitudinally extending board 15 of a bed 11, while the other support 13*b* is mounted on a movable carriage 17, and wherein a lifting/hanging mechanism part 18 capable of being moved along a traveling rail 14 while lifting and hanging down an aged person or the like is mounted in a suspended state to the traveling rail 14, so that with the aged person or the like lifted with the lifting/hanging mechanism part 18, the support 13*b* supported on the movable carriage 17 is moved to a position beside the bed 11, thus allowing the aged person or the like to be moved to a wheelchair or the like placed beside the bed 11.

According to the caring lift disclosed in the patent document 6, a reduction in size is achieved.

However, this caring lift cannot be said to be of a stationary type and has a fear of impairing stability due to its structure by which the support 13*b* supported on the movable carriage 17 is moved rotationally.

REFERENCE LITERATURES IN THE RELATED ARTS

Patent Documents

Patent document 1: Japanese Unexamined Patent Application Publication No. 2001-327553

Patent document 2: Japanese Unexamined Patent Application Publication No. 2000-350750

Patent document 3: Japanese Unexamined Patent Application Publication No. Hei 6-343666

Patent document 4: Japanese Unexamined Patent Application Publication No. Hei 6-209970

Patent document 5: Japanese Unexamined Patent Application Publication No. 2013-121475

Patent document 6: Japanese Unexamined Patent Application Publication No. 2001-061906

SUMMARY OF THE INVENTION

Problems to be Solved by the Invention

An object of the present invention is to provide a stationary type caring lift which achieves a reduction in size while securing stability and hence realizes a reduction in introduction cost.

Means for Solving the Problems

To solve the above problems, the present invention provides a stationary type caring lift which comprises:

a base plate arranged on a floor part at each of head and foot sides of a bed for a care receiver along each short-side side of the bed in planar view, four supports erected on the base plates through brackets in the vicinity of four corners of the bed, a pair of guide rails supported above the bed by the four supports and arranged in parallel along both long-side sides of the bed in planar view, a longitudinally moving body arranged between the pair of guide rails and capable of being moved in a longitudinal direction of the bed while being guided by the pair of guide rails, a slide rail attached movably in a lateral direction of the bed relative to the longitudinally moving body and capable of being protruded outward from the pair of guide rails, a laterally moving body attached movably in the lateral direction of the bed relative to the slide rail and a lifting drive mechanism attached in the laterally moving body for hanging down the care receiver and having a worm reduction gear with a self-lock function.

The stationary type caring lift of the present invention can be installed at a place for use thereof in a manner in which:

the base plate is arranged on the floor part at each of the head and foot sides of the bed for the care receiver along each short-side side of the bed in planar view, the four supports are then erected on the base plates through the brackets in the vicinity of the four corners of the bed, the pair of guide rails arranged in parallel along both long-side sides of the bed in planar view are then supported above the bed by the four supports, the longitudinally moving body capable of being moved in the longitudinal direction of the bed while being guided by the pair of guide rails is then arranged between the pair of guide rails, the slide rail capable of being protruded outward from the pair of guide rails is then attached movably in the lateral direction of the bed relative to the longitudinally moving body, the laterally moving body is then attached movably in the lateral direction of the bed relative to the slide rail and, the lifting drive mechanism for hanging down the care receiver and having the worm reduction gear with the self-lock function is then attached in the laterally moving body.

According to the stationary type caring lift of the present invention, the slide rail capable of being protruded outward from the pair of guide rails is attached movably in the lateral direction of the bed relative to the longitudinally moving body, the laterally moving body is attached movably in the lateral direction of the bed relative to the slide rail, and the lifting drive mechanism for hanging down the care receiver is attached in the laterally moving body. By so doing, even though the pair of guide rails are arranged in parallel along both long-side sides of the bed in planar view, the laterally moving body can be protruded outward from the pair of guide rails by protruding the slide rail outward from the pair of guide rails, thus enabling the care receiver to be moved from on the bed to an outside of the bed with the lifting drive mechanism.

Namely, the stationary type caring lift of the present invention enables the care receiver to be moved from on the bed to the outside of the bed with the lifting drive mechanism without any necessity for the pair of guide rails arranged above the bed to be placed at a position largely away from the bed for securement of a moving area of the lifting drive mechanism.

Further, the pair of guide rails are supported by the four supports, so that supporting in a stable state can be secured.

Accordingly, the stationary type caring lift of the present invention enables a reduction in size to be achieved while securing stability and hence a reduction in introduction cost to be realized.

Besides, the lifting drive mechanism has the worm reduction gear with the self-lock function, so that the safety can be enhanced.

It may be possible also to constitute the stationary type caring lift of the present invention such that the slide rail is supported by at least three rollers provided along the lateral direction of the longitudinally moving body, while stoppers for regulating an amount of protrusion of the slide rail are provided between the slide rail and the longitudinally moving body, thus allowing the slide rail to be supported by at least two rollers out of at least the three rollers when the stoppers are in operation.

With such a constitution, the slide rail is supported by at least two rollers even when the amount of protrusion of the slide rail is the maximum, so that a stably protruding state can be obtained.

It may be possible also to constitute the stationary type caring lift of the present invention such that wiring for power supply to the lifting drive mechanism is arranged through a pla-rail chain arranged at the guide rail while permitting such wiring to be inserted in a pipe which constitutes the support.

With such a constitution, an ordinary domestic power supply can be used in a compact wiring structure.

It may be possible also to constitute the stationary type caring lift of the present invention such that with respect to the lateral direction of the bed, a length of the base plate is made larger than a spacing between the pair of guide rails.

With such a constitution, all of the pair of guide rails, the longitudinally moving body, the slide rail, the laterally moving body and the lifting drive mechanism can be supported in a stable state.

It may be possible also to constitute the stationary type caring lift of the present invention such as to further include:

a protrusion regulating mechanism having a regulating member which selectively takes a regulating position for regulating protrusion of the slide rail from the longitudinally moving body and a regulation releasing position for permitting such protrusion of the slide rail and a connecting/releasing mechanism for making a connection between the slide rail and the laterally moving body when the slide rail gets protruded from the longitudinally moving body, while releasing the connection between the slide rail and the laterally moving body when the regulating member is placed at the regulating position.

With such a constitution, as the regulating member of the protrusion regulating mechanism takes the regulating position, the slide rail can be prevented from its unnecessary protrusion from the longitudinally moving body.

Further, the slide rail and the laterally moving body are connected by the connecting/releasing mechanism when the slide rail gets protruded from the longitudinally moving body, so that the slide rail can be also moved toward the longitudinally moving body by moving the laterally moving body toward the longitudinally moving body after the connection between the slide rail and the laterally moving body is established. Besides, the connection between the slide rail and the laterally moving body is released after the regulating member is placed at the regulating position, so that the laterally moving body can be moved along the slide rail.

Accordingly, the stationary type caring lift of high usability can be obtained.

BRIEF DESCRIPTION OF THE DRAWINGS

FIG. 8 is a plan view for explaining the operation of the protrusion regulating mechanism 50 and that of the connecting/releasing mechanism 60.

FIG. 9 is a plan view for explaining the operation of the protrusion regulating mechanism 50 and that of the connecting/releasing mechanism 60.

MODE FOR EMBODYING THE INVENTION

Figure 1:
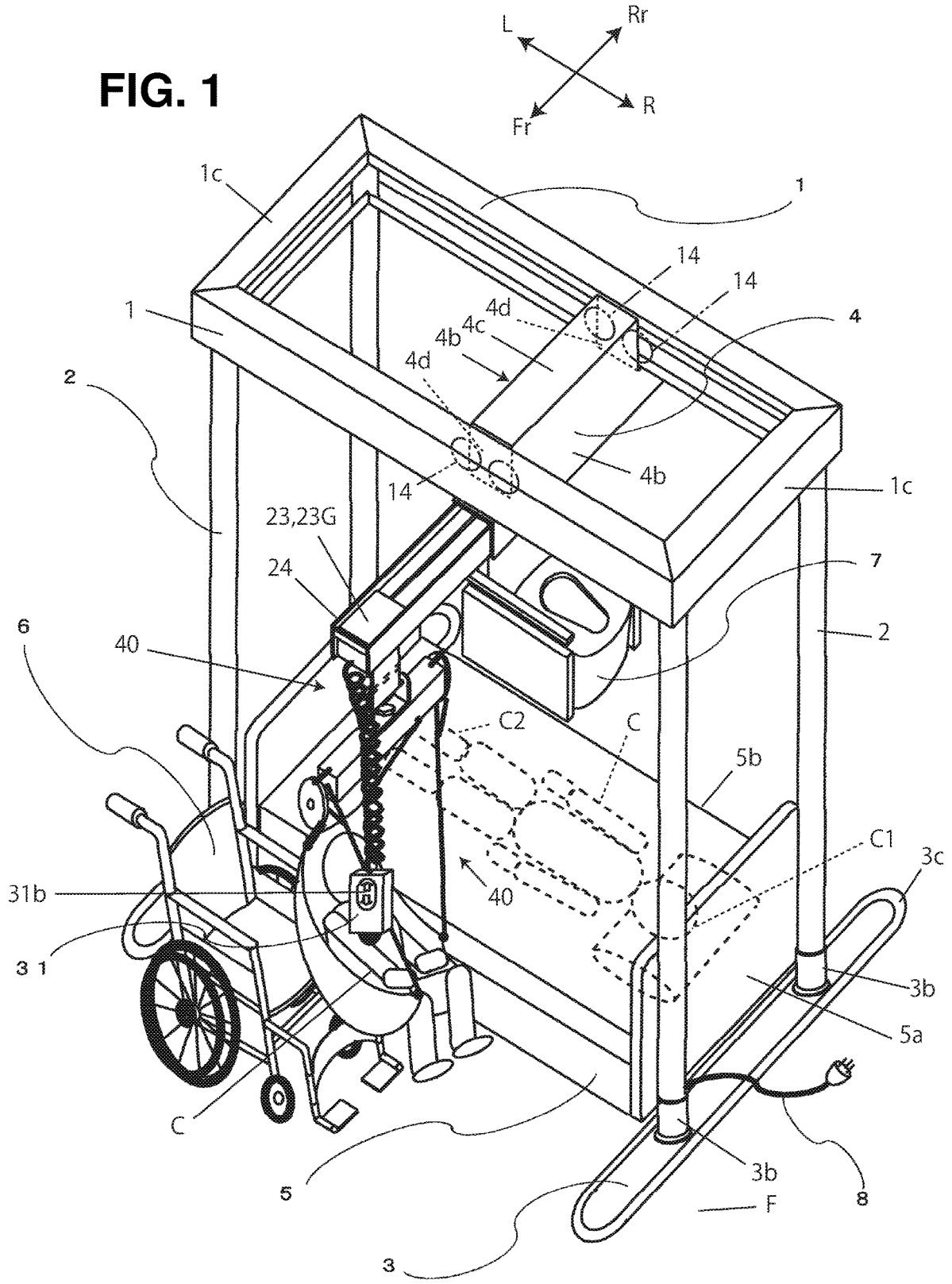
FIG. 1 is a perspective view showing one usage state of an embodiment of a stationary type caring lift according to the present invention.

Hereinafter will be described an embodiment of a stationary type caring lift according to the present invention with reference to the attached drawings. It is noted that the front, rear, left, right, upside and downside of the stationary type caring lift are respectively indicated by Fr, Rr, L, R, U and D in the drawings as needed. Referring to each drawing, like reference numerals indicate like or corresponding parts throughout.

Figure 2:
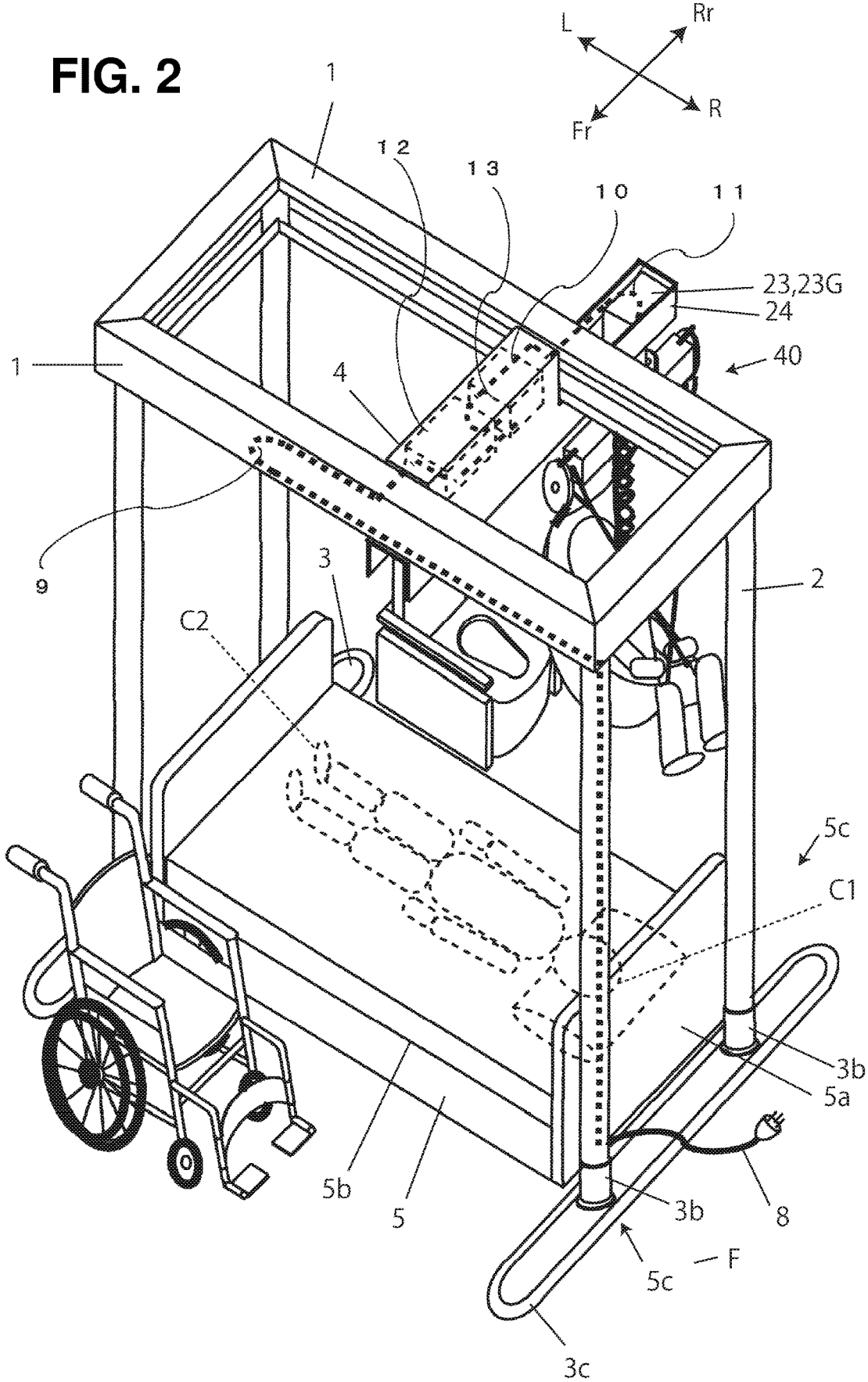
FIG. 2 is a perspective view showing another usage state of the above embodiment.
Figure 3:
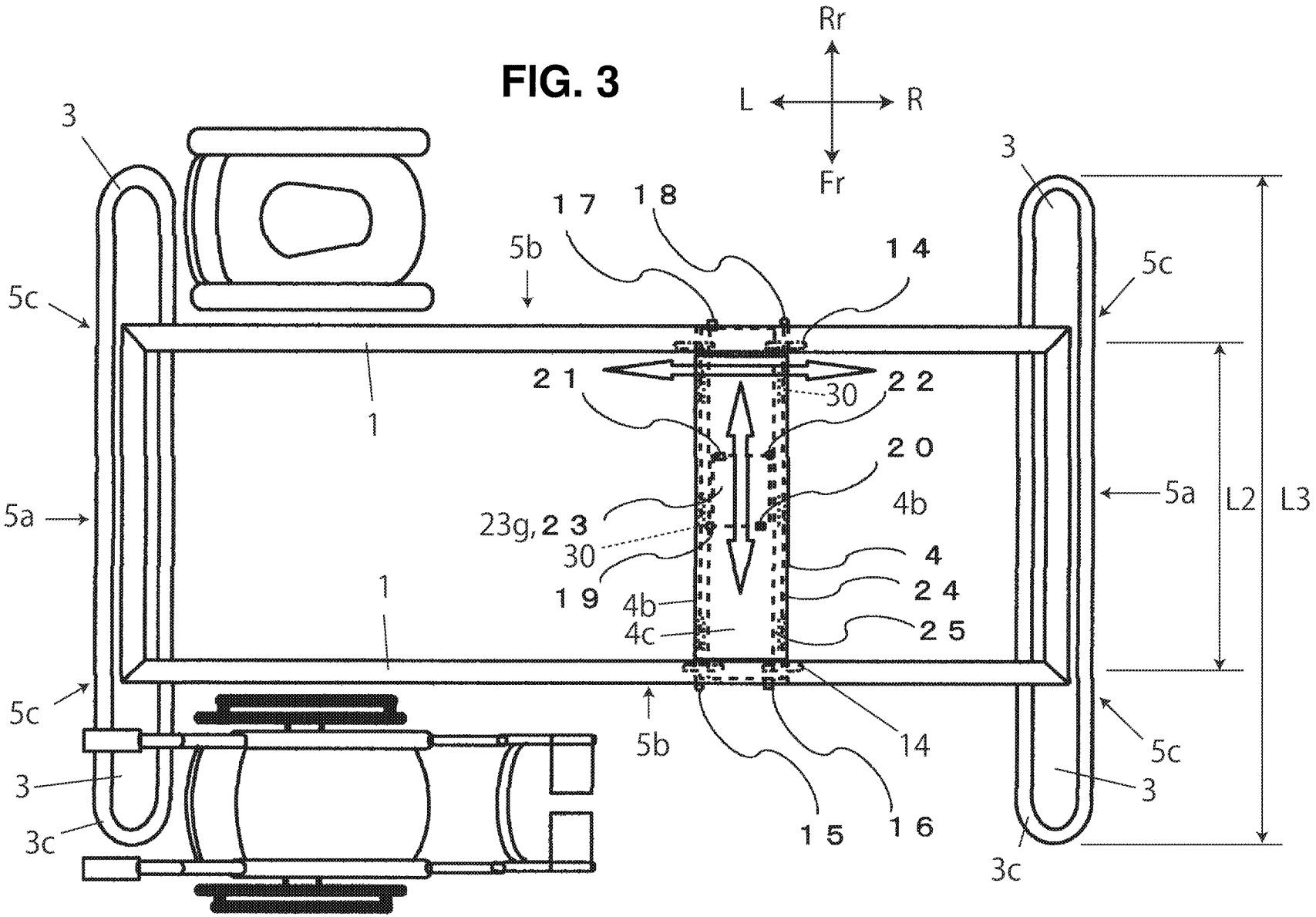
FIG. 3 is a schematic plan view showing the above embodiment.

As shown in FIGS. 1 to 3, the stationary type caring lift in this embodiment includes:

a base plate 3 arranged on a floor part F at each of head C1 and foot C2 sides of a bed 5 for a care receiver C along each short-side 5*a* side of the bed 5 in planar view, four supports 2 erected on the base plates 3 through brackets 3*b* in the vicinity of four corners 5*c* of the bed 5, a pair of guide rails 1, 1 supported above the bed 5 by the four supports 2 and arranged in parallel along both long-side 5*b* sides of the bed 5 in planar view, a longitudinally moving body 4 arranged between the pair of guide rails 1, 1 and capable of being moved in a longitudinal direction (directions of arrows L and R) of the bed 5 while being guided by the pair of guide rails 1,1, a slide rail 24 attached movably in a lateral direction (directions of arrows Fr and Rr) of the bed 5 relative to the longitudinally moving body 4 and capable of being protruded outward (in the directions of arrows Fr and Rr) from the pair of guide rails 1, 1, a laterally moving body 23 attached movably in the lateral direction (the directions of arrows Fr and Rr) of the bed 5 relative to the slide rail 24 and a lifting drive mechanism 23G (see FIG. 11) attached in the laterally moving body 23 for hanging down the care receiver C and having a worm reduction gear with a self-lock function.

As shown in FIGS. 1 to 3, the stationary type caring lift in this embodiment can be installed at a place for use thereof in a manner in which:

the base plate 3 is arranged on the floor part F at each of the head C1 and foot C2 sides of the bed 5 for the care receiver C along each short-side 5*a* side of the bed 5 in planar view, the four supports 4 are then erected on the base plates 3 through the brackets 3*b* in the vicinity of the four corners 5*c* of the bed 5, the pair of guide rails 1, 1 arranged in parallel along both long-side 5*b* sides of the bed 5 in planar view are then supported above the bed 5 by the four supports 2, the longitudinally moving body 4 capable of being moved in the longitudinal direction of the bed 5 while being guided by the pair of guide rails 1, 1 is then arranged between the pair of guide rails 1, 1, the slide rail 24 capable of being protruded outward from the pair of guide rails 1, 1 is then attached movably in the lateral direction of the bed 5 relative to the longitudinally moving body 4, the laterally moving body 23 is then attached movably in the lateral direction of the bed 5 relative to the slide rail 24, and the lifting drive mechanism 23G for hanging down the care receiver C and having the worm reduction gear with the self-lock function is then attached in the laterally moving body 23.

It is noted that the longitudinally moving body 4, the slide rail 24, the laterally moving body 23 and the lifting drive mechanism 23G may be also preliminarily sub-assembled in one unit.

According to the stationary type caring lift in this embodiment, as shown in FIG. 1 or 2, the slide rail 24 capable of being protruded outward from the pair of guide rails 1, 1 is attached movably in the lateral direction (the directions of arrows Fr and Rr) of the bed 5 relative to the longitudinally moving body 4, the laterally moving body 23 is attached movably in the lateral direction (the directions of arrows Fr and Rr) of the bed 5 relative to the slide rail 24, and the lifting drive mechanism 23G for hanging down the care receiver C is attached in the laterally moving body 23. By so doing, even though the pair of guide rails 1, 1 are arranged in parallel along both long-side sides of the bed 5 in planar view, the laterally moving body 23 can be protruded outward from the pair of guide rails 1, 1 by protruding the slide rail 24 outward (in the directions of arrows Fr and Rr) from the pair of guide rails 1, 1, thus enabling the care receiver C to be moved from on the bed 5 to an outside of the bed 5 (or vice versa) with the lifting drive mechanism 23G.

Namely, the stationary type caring lift in this embodiment enables the care receiver C to be moved from on the bed 5 to the outside of the bed 5 with the lifting drive mechanism 23G without any necessity for the pair of guide rails 1, 1 arranged above the bed 5 to be placed at a position largely away from the bed 5 for securement of a moving area of the lifting drive mechanism 23G.

Further, the pair of guide rails 1, 1 are supported by the four supports 2, so that supporting in a stable state can be secured.

Accordingly, the stationary type caring lift in this embodiment enables a reduction in size to be achieved while securing stability and hence a reduction in introduction cost to be realized.

Besides, the lifting drive mechanism 23G has the worm reduction gear with the self-lock function, so that the safety can be enhanced.

The base plate 3 may be constituted of a publicly known material having an appropriate strength.

In this embodiment, the base plate 3 is constituted of a flat bar with a back face to which a non-slip sheet is stuck, a front face to which a floor sheet is stuck and a peripheral edge which is subjected to large chamfering. A chamfered part is indicated by 3*c*.

Figure 1A:
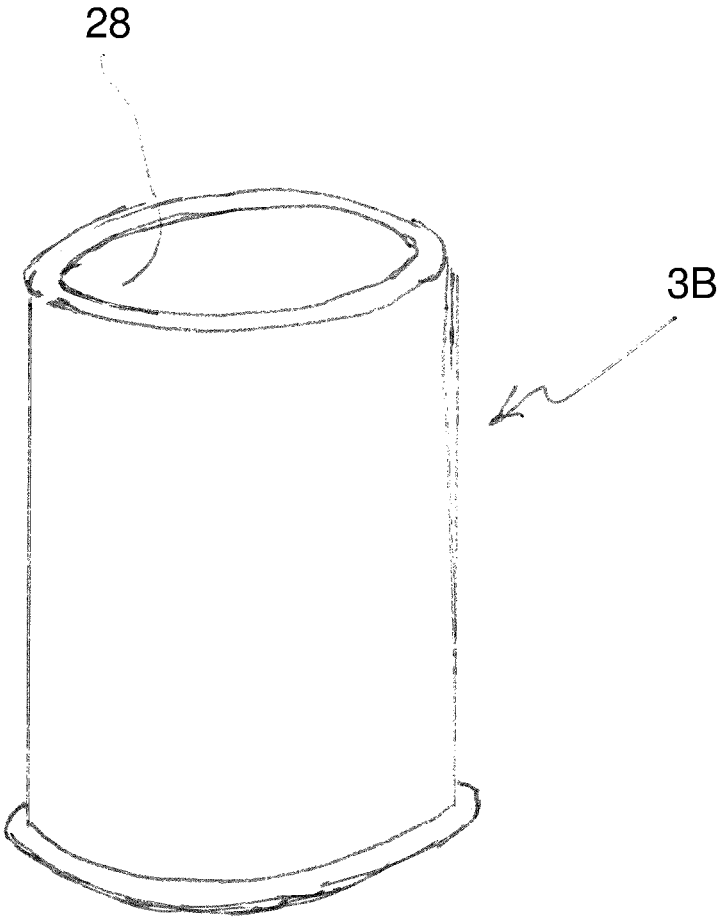
FIG. 1A is a first detail perspective view showing a bracket which is a component part of the caring lift.

The support 2 may be constituted of a publicly known material having an appropriate strength. In this embodiment, the support 2 is a metal pipe. The bracket 3*b* is a metal pipe bracket. Referring now to FIG. 1A, the bracket 3*b* is shown separately from the support 2. As shown in FIG. 1A, the bracket 3*b* has a hollow opening 28 formed therein and facing upwardly, the opening 28 configured to nestingly receive a base portion of the support 2 therein.

The guide rail 1 itself may be constituted of a publicly known appropriate material.

In this embodiment, the guide rail 1 is constituted of a steel material for a cross-sectional C-shaped guide rail having a rail groove 1*b*.

Referring to FIG. 1, reference numeral 1*c* indicates a reinforcing material through which the pair of guide rails 1, 1 are connected.

The longitudinally moving body 4 may adopt any appropriate constitution if being such that it is possible to constitute the longitudinally moving body so as to be capable of being moved in the longitudinal direction (the directions of arrows L and R) of the bed 5 while being guided by the pair of guide rails 1, 1 and also to allow the slide rail 24 to be guided.

The longitudinally moving body 4 in this embodiment is approximately in the form of a casing on the whole and has a pair of side plates 4*b*, 4*b* each having a protrusive configuration in side view, a top plate 4*c* through which the upper sides of the side plates 4*b*, 4*b* are connected and front and rear plates 4*d*, 4*d* through which the sides of the side plates 4*b*, 4*b* as being opposed to the guide rails 1 are connected. Each of the front and rear plates 4*d*, 4*d* has two wheels 14, wherein as the four wheels 14 are rolled in the guide rails 1, the longitudinally moving body 4 can be moved in the longitudinal direction (the directions of arrows L and R) of the bed 5 while being guided by the pair of guide rails 1, 1.

It is noted that a bottom face of the longitudinally moving body 4 is opened.

The slide rail 24 may adopt any appropriate constitution if being such that it is possible to constitute the slide rail so as to be capable of being moved in the lateral direction (the directions of arrows Fr and Rr) of the bed 5 relative to the longitudinally moving body 4 and being protruded outward (in the directions of arrows Fr and Rr) from the pair of guide rails 1, 1 and also to allow the laterally moving body 23 to be guided in the lateral direction (the directions of arrows Fr and Rr).

Figure 4:
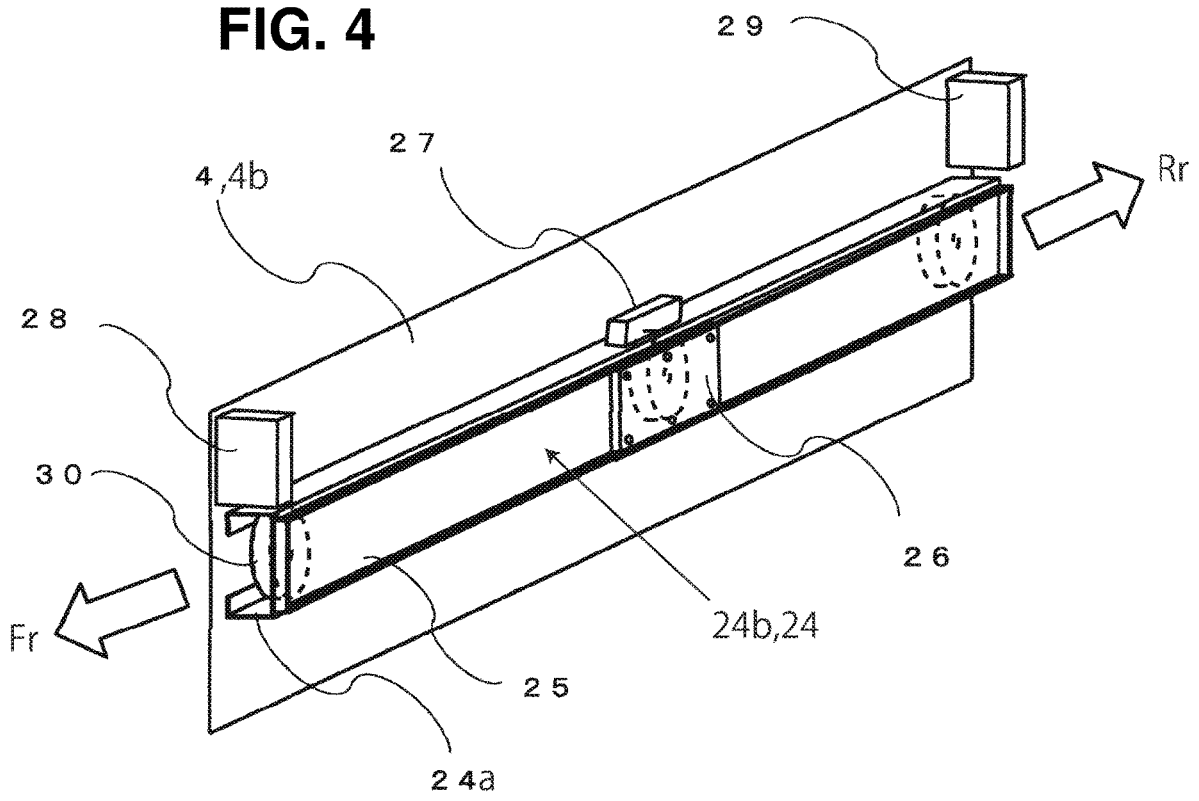
FIG. 4 is a detail perspective view showing a longitudinally moving body 4 and a slide rail 24.
Figure 12:
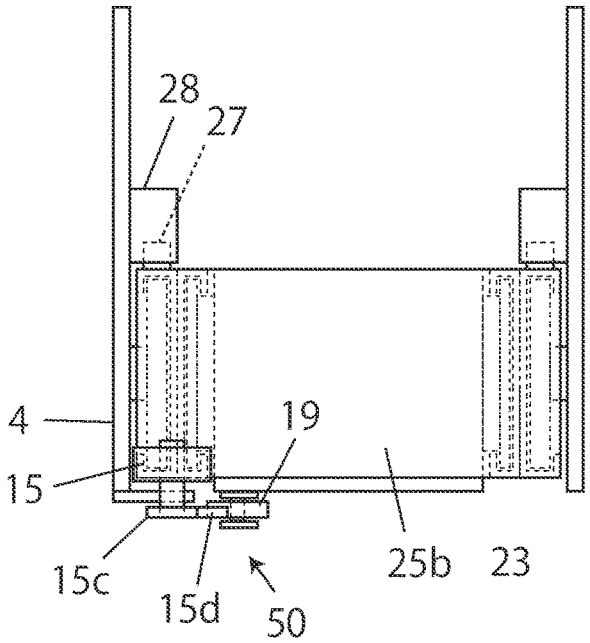
FIG. 12 mainly shows an essential part of the longitudinally moving body 4 and that of the slide rail 24, wherein FIG. 12(*a*) is a front view, partially omitted, FIG. 12(*b*) is a side view, partially omitted, and FIG. 12(*c*) is a front view with a front plate omitted.
Figure 12:
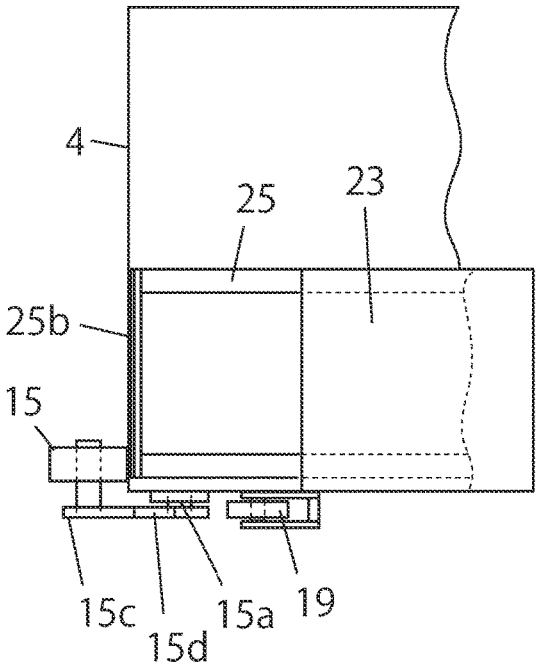
Figure 12:
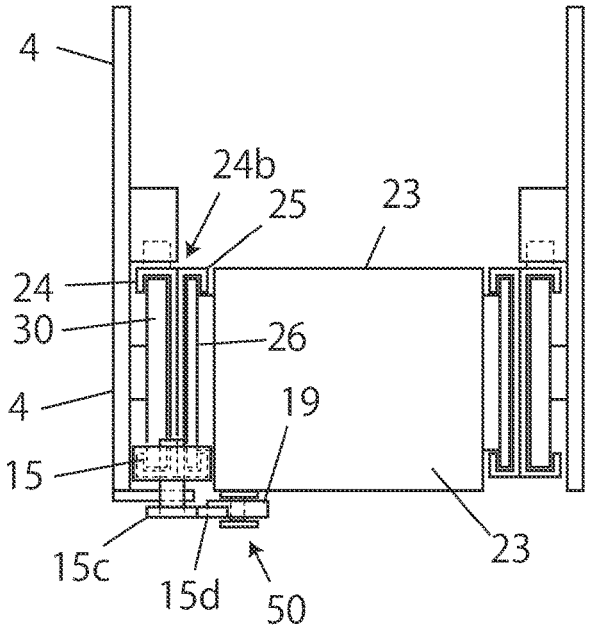

The slide rail 24 in this embodiment is constituted such that both-sided rails 24*b* each obtained by fixing back to back and integrating cross-sectional C-shaped rails 24*a*, 25 as shown in FIG. 4, for instance, are arranged in parallel and facing to each other as shown in FIG. 12 (*a*), and the end faces of the inner-side rails 25 are then connected together through front and rear plates 25*b*.

As shown in FIGS. 3 to 6, the slide rail 24 is supported by three rollers 30 provided along the lateral direction (the directions of arrows Fr and Rr) of the longitudinally moving body 4, while stoppers 27, 29 for regulating an amount L1 of protrusion of the slide rail 24 from the longitudinally moving body 4 are provided between the slide rail 24 and the longitudinally moving body 4.

Figure 5:
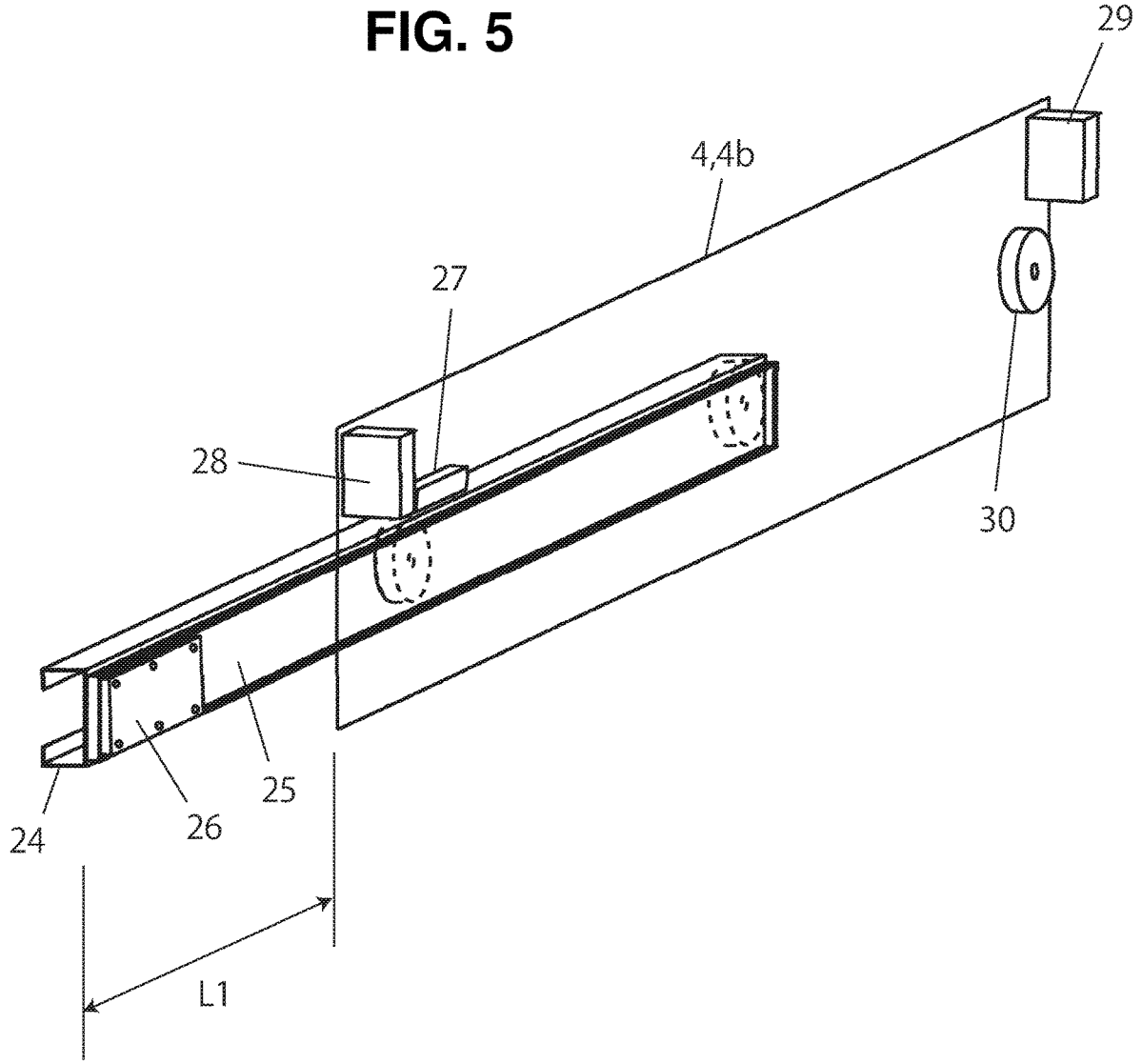
FIG. 5 is a detail perspective view showing the longitudinally moving body 4 and the slide rail 24.
Figure 6:
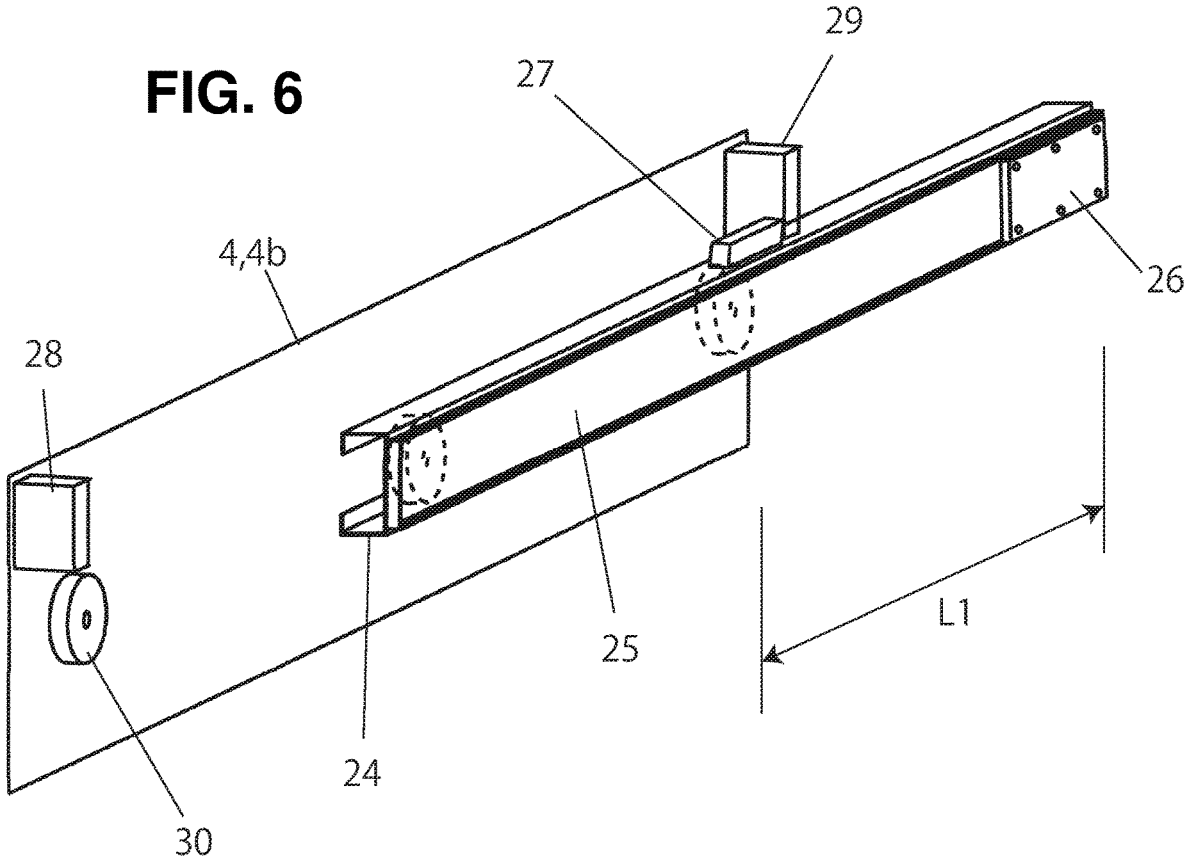
FIG. 6 is a detail perspective view showing the longitudinally moving body 4 and the slide rail 24.

As shown in FIGS. 5 and 6, the slide rail 24 is supported by at least two rollers out of the three rollers when the stoppers 27, 29 are in operation.

The number of rollers 30 may be also increased to not less than three.

With such a constitution, the slide rail 24 is supported by at least the two rollers 30 even when the amount of protrusion of the slide rail 24 is the maximum, so that a stably protruding state can be obtained.

It is noted that the stopper 27 is fixed to the slide rail 24, while the stopper 29 is fixed to an inner face of the side plate 4*b* of the longitudinally moving body 4.

The laterally moving body 23 may adopt any appropriate constitution if being such that it is possible to constitute the laterally moving body so as to have the lifting drive mechanism 23G and also to be guided in the lateral direction (the directions of arrows Fr and Rr) of the bed 5 by the slide rail 24.

The laterally moving body 23 in this embodiment has an approximately casing-like structure and can be moved in the lateral direction (the directions of arrows Fr and Rr) of the bed 5, as a slider 26 fixed to the right and left faces of the laterally moving body is guided by the inner-side rail 25 of the slide rail 24.

Figure 11:
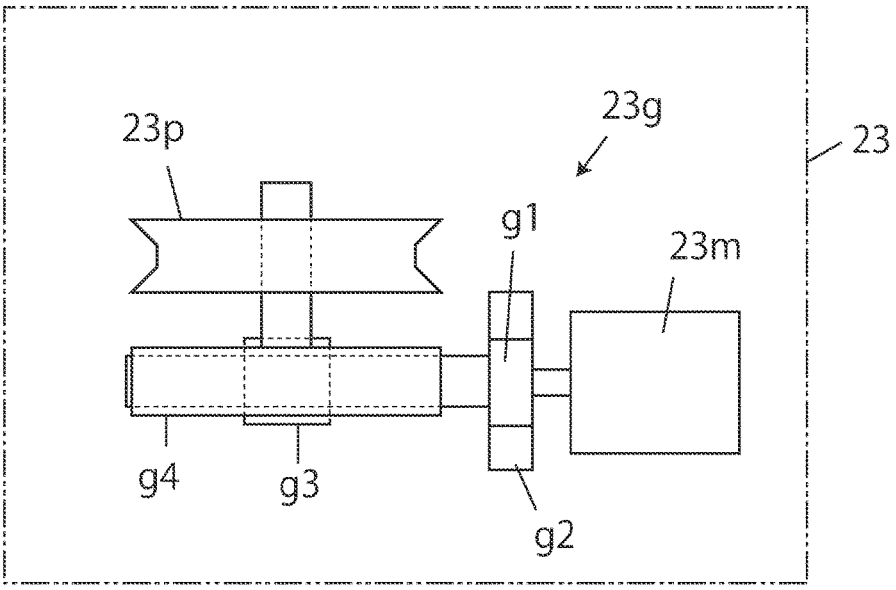
FIG. 11 shows an outline of a structure of a lifting drive mechanism 23G, wherein FIG. 11(*a*) is a plan view, and FIG. 11(*b*) is a front view.
Figure 11:
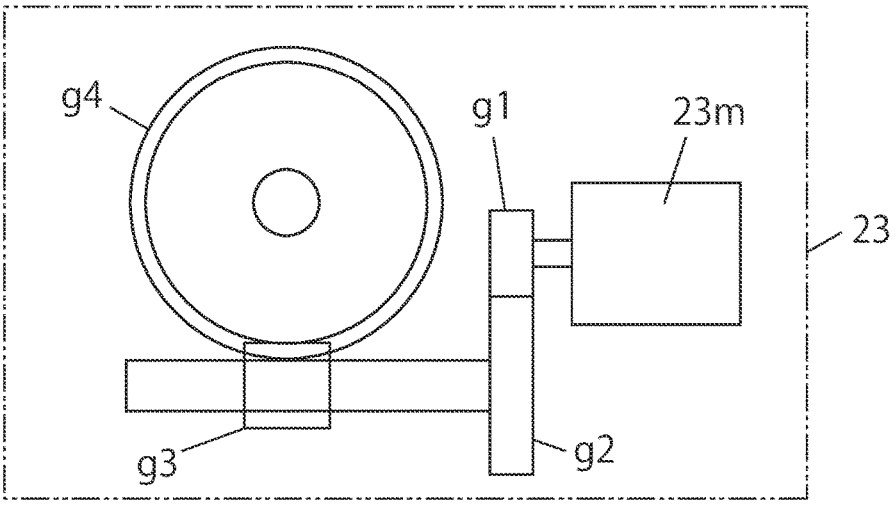

The lifting drive mechanism 23G may be constituted of a publicly known mechanism having a worm reduction gear with a self-lock function. As shown in FIG. 11, for instance, a mechanism including a worm g3 driven by a motor 23*m* through gears g1, g2, a worm wheel g4 meshing with the worm g3 and a pulley 23*p* rotated coaxially together with the worm wheel g4 is adoptable to the lifting drive mechanism 23G. A reduction ratio of the worm g3 to the worm wheel g4 is set to be not less than 1/50.

A wire or a belt for lifting up/down a publicly known hanger 40 for hanging the care receiver C is wound round the pulley 23*p*.

As shown in FIGS. 7 to 10, the stationary type caring lift in this embodiment further includes:

a protrusion regulating mechanism 50 having a regulating member 15 which selectively takes a regulating position P1 for regulating protrusion of the slide rail 24 from the longitudinally moving body 4 and a regulation releasing position P2 for permitting such protrusion of the slide rail and a connecting/releasing mechanism 60 for making a connection between the slide rail 24 and the laterally moving body 23 when the slide rail 24 gets protruded from the longitudinally moving body 4, while releasing the connection between the slide rail 24 and the laterally moving body 23 when the regulating member 15 is placed at the regulating position P1.

Figure 7:
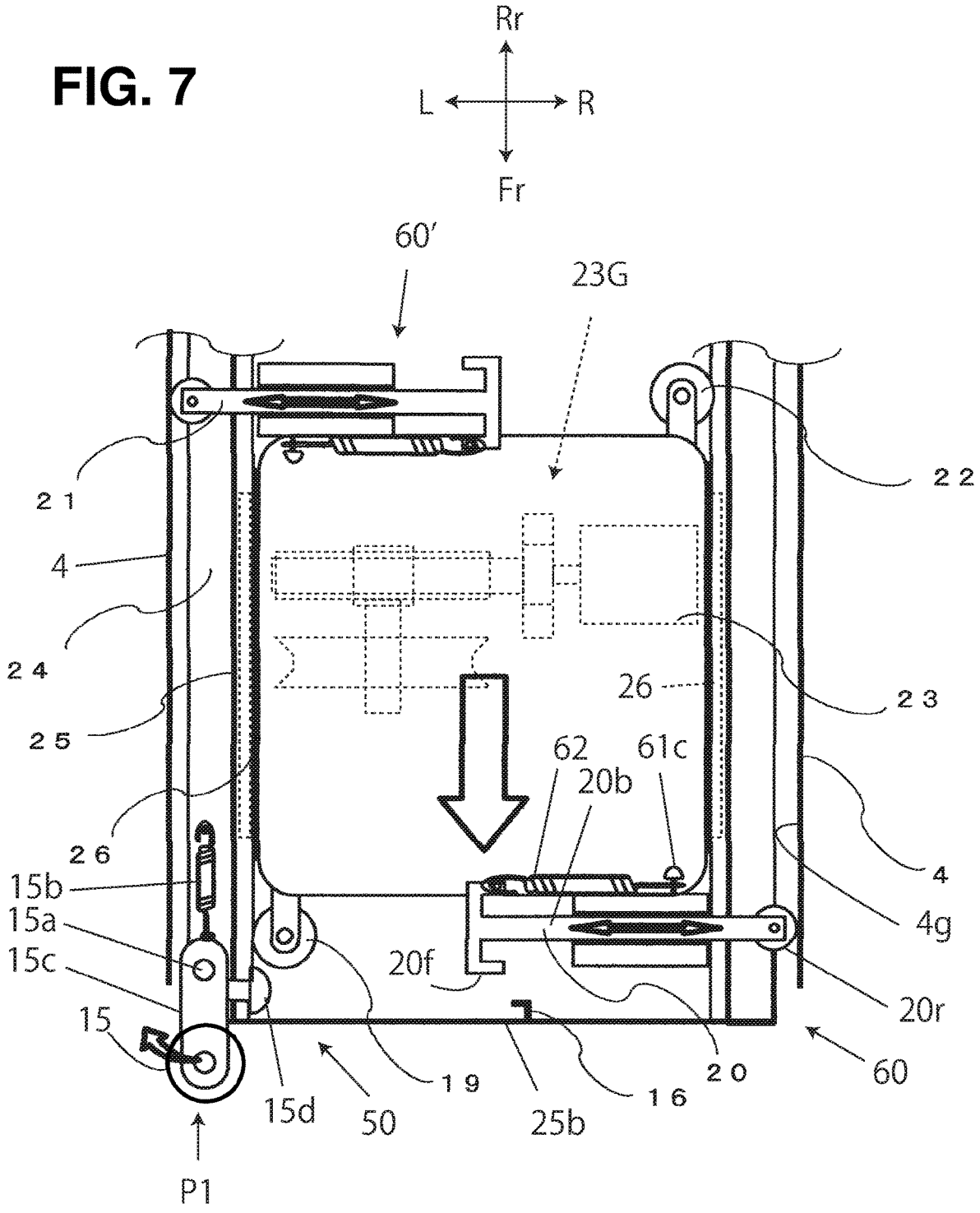
FIG. 7 is a plan view for explaining an operation of a protrusion regulating mechanism 50 and that of a connecting/releasing mechanism 60.

With such a constitution, as the regulating member 15 of the protrusion regulating mechanism 50 takes the regulating position P1 as shown in FIG. 7, the slide rail 24 can be prevented from its unnecessary protrusion from the longitudinally moving body 4.

Figure 10:
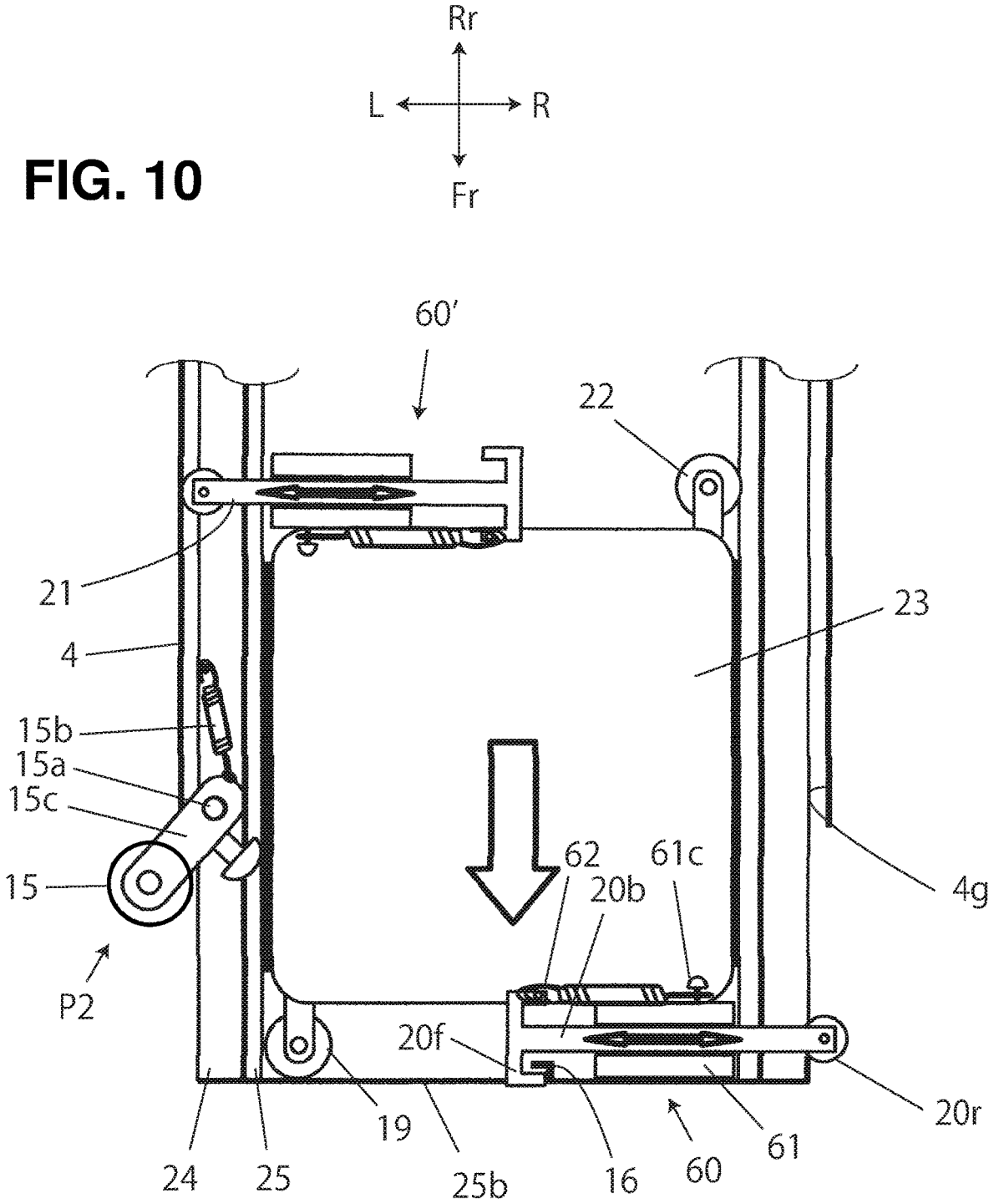
FIG. 10 is a plan view for explaining the operation of the protrusion regulating mechanism 50 and that of the connecting/releasing mechanism 60.

Further, the slide rail 24 and the laterally moving body 23 are connected by the connecting/releasing mechanism 60 as shown in FIGS. 9 and 10 when the slide rail 24 gets protruded from the longitudinally moving body 4, so that the slide rail 24 can be also moved toward the longitudinally moving body 4 by moving the laterally moving body 23 toward the longitudinally moving body 4 (in the direction of arrow Rr) after the connection between the slide rail and the laterally moving body is established. Besides, the connection between the slide rail 24 and the laterally moving body 23 is released after the regulating member 15 is placed at the regulating position P1 (see FIG. 7), so that the laterally moving body 23 can be moved along the slide rail 24.

Accordingly, the stationary type caring lift of high usability can be obtained.

As shown in FIGS. 7 to 10, the protrusion regulating mechanism. 50 in this embodiment includes the regulating member 15, an energizing member 15*b* for normally energizing the regulating member 15 toward the regulating position P1, and a roller 19 provided at the laterally moving body 23 to move the regulating member 15 toward a non-regulating position (the regulation releasing position) P2 against an energizing force of the energizing member 15*b*.

As shown also in FIG. 12, the energizing member 15 is provided rotatably on an arm 15*c* provided on a bottom part of the longitudinally moving body 4 so as to be moved rotationally by a shaft 15*a*, and is to regulate the protrusion of the slide rail 24 from the longitudinally moving body 4 by making contact with an end of the slide rail 24, when placed at the regulating position (see FIG. 7).

On the other hand, as shown in FIG. 8, as a contacted part 15*d* provided on the arm 15*c* comes into contact with the roller 19 with the movement of the laterally moving body 23, the regulating member is moved (moved rotationally) to the non-regulating position P2 to go into a state of permitting the protrusion of the slide rail 24 from the longitudinally moving body 4.

As shown in FIGS. 7 to 10, the connecting/releasing mechanism 60 in this embodiment includes a hook 16 provided at the slide rail 24 and a slide hook 20 provided at the laterally moving body 23.

The slide hook 20 is a member of an approximately T-like shape in planar view, which includes a laterally extending base part 20*b*, a hook part 20*f* provided at one end of the base part 20*b*, a spring hook part 20*c* and a roller 20*r* provided rotatably at the other end of the base part 20*b*, and is supported in a laterally slidable manner by a guide block 61 provided at a front part of the laterally moving body 23.

A tension spring 62 is provided between the spring hook part 20*c* and a spring hook part 61*c* of the guide block 61, so that the slide hook 20 is energized in such a direction that the hook part 20*f* is engaged with the hook 16 of the slide rail 24, whereas when the regulating member 15 is placed at the regulating position P1 where the slide rail 24 is in a state of being not protruded from the longitudinally moving body 4 as shown in FIG. 7, sliding of the slide hook is regulated by contact of the roller 20*r* with an inner face 4*g* of the longitudinally moving body 4, and hence, the hook part 20*f* is not engaged with the hook 16.

Accordingly, no connection between the laterally moving body 23 and the slide rail 24 is established, resulting in that the laterally moving body 23 can be moved along the slide rail 24.

On the other hand, as shown in FIGS. 8 to 10, for instance, when the laterally moving body 23 is moved forward (in the direction of arrow Fr), the front plate 25*b* of the slide rail 24 is pressed by the guide block 61 so that the slide rail 24 gets protruded, in which process, when the roller 20*r* is detached from the inner face 4*g* of the longitudinally moving body 4 as shown in FIGS. 8 and 9, the slide hook 20 is allowed to slide rightward, and hence, the hook part 20*f* is engaged with the hook 16.

Accordingly, the laterally moving body 23 and the slide rail 24 are connected, resulting in that the slide rail 24 can be also moved toward the longitudinally moving body 4 by moving the laterally moving body 23 toward the longitudinally moving body 4 (in the direction of arrow Rr) after the connection between the laterally moving body and the slide rail is established.

The projection regulating mechanism 50 and the connecting/releasing mechanism 60 as described the above are provided so as to be in a point symmetrical arrangement in the front and the rear. Referring to FIGS. 7 to 10, reference numeral 22 indicates a roller of the rear protrusion regulating mechanism 50, and 60' indicates a rear connecting/releasing mechanism.

Referring to FIG. 2, reference numeral 8 indicates an electric outlet connected to a domestic power supply, and 13 indicates a motor controller for driving the motor 23*m* of the lifting drive mechanism 23G.

Wiring 33 for supplying power to the motor controller 13, that is, to the lifting drive mechanism 23G is arranged through a pla-rail chain 9, arranged at the guide rail 1 while permitting such wiring to be inserted in a pipe 2 which constitutes the support 2.

Figure 2A:
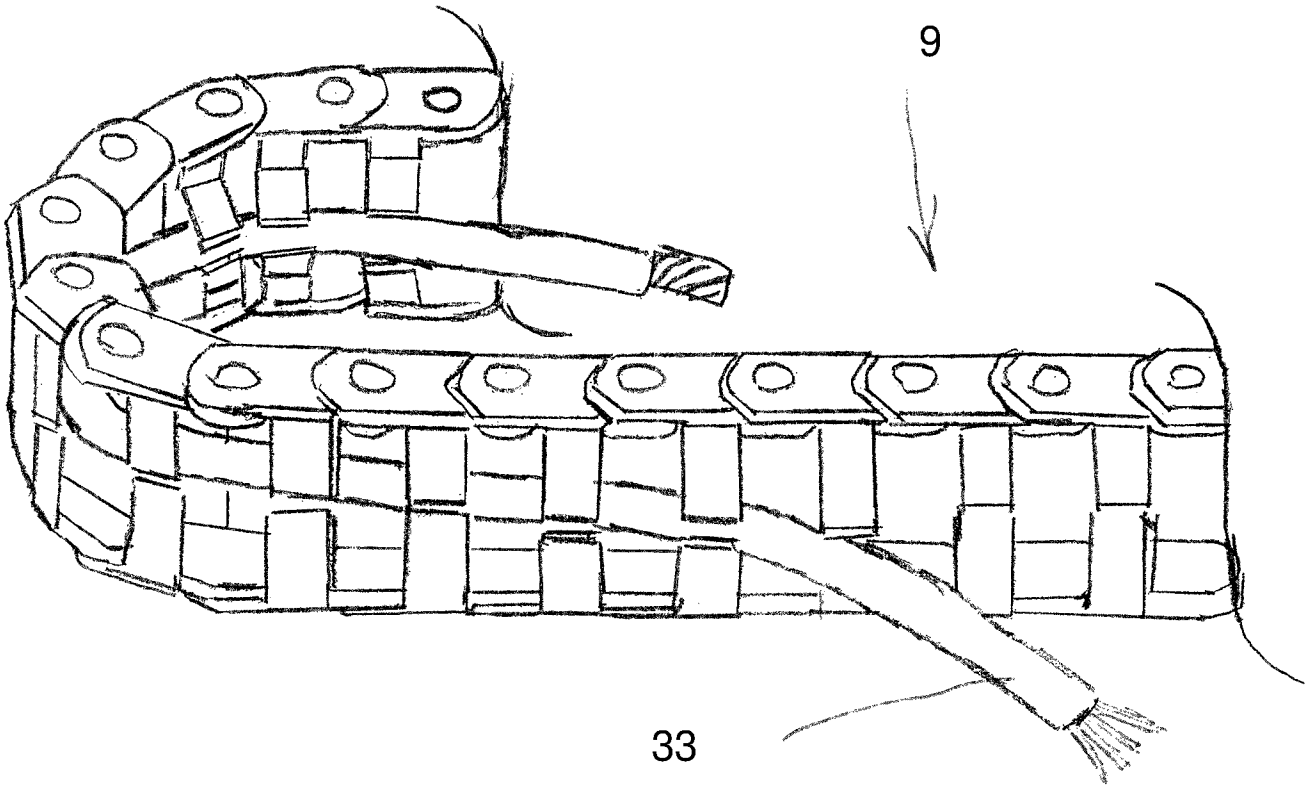
FIG. 2A is another detail perspective view showing a cut away section of a pla-rail which is another component part of the caring lift.

FIG. 2A is a detail perspective view of a portion of the pla-rail chain 9. also showing a portion of the wiring 33 extending through the pla-rail chain.

It is noted that reference numeral 10 indicates a pla-rail chain arranged between the motor controller 13 and the slide rail 24, and 11 indicates a pla-rail chain arranged between the slide rail 24 and the motor 23*m*.

With such a constitution, an ordinary domestic power supply can be used in a compact wiring structure.

To the motor controller 13 is connected a switch box 31. The switch box 31 includes a lifting button 31*b* for actuating the lifting drive mechanism 23G to lift up/down the hanger 40. An emergency stop button (not shown) is also included.

Referring to FIG. 2, reference numeral 12 indicates an uninterruptible power supply.

With respect to the lateral direction of the bed 5, a length L3 of the base plate 3 is made larger than a spacing L2 between the pair of guide rails 1, 1.

With such a constitution, all of the pair of guide rails 1, 1, the longitudinally moving body 4, the slide rail 24, the laterally moving body 23 and the lifting drive mechanism 23G can be supported in a stable state.

The stationary type caring lift having the above constitution is available for use as follows, for instance.

The longitudinally moving body 4 and the laterally moving body 23 (the lifting drive mechanism 23G) are moved until their proper place on the bed 5. At this time, it is possible to move these moving bodies while gripping the hanger 40 or the like.

Then, after mounting of a caring lift sling 41 to the care receiver C lying on the bed, the caring lift sling 41 is connected to the hanger 40, and the hanger 40 is then moved upward with the switch box 31 to hang down the care receiver C, followed by moving the care receiver C onto a wheelchair 6, for instance, while a care giver (not sown) holds a part or the like of the body of the care receiver C. At this time, the longitudinally moving body 4 and the laterally moving body 23 are also moved with the movement of the hanger 40 together with the care receiver C, in which process, when the laterally moving body 23 is moved to the end of the slide rail 24 so that the regulation regarding the slide rail 24 by the protrusion regulating mechanism 50 is released as described in the foregoing with reference to FIGS. 7 to 10, the slide rail 24 gets protruded from the longitudinally moving body 4 with the movement of the laterally moving body 23 (see FIG. 1).

Afterwards, the hanger 40 is moved downward with the switch box 31 to allow the care receiver C to sit on the wheelchair 6.

On the contrary, when moving the care receiver C from the wheelchair 6 onto the bed 5, an action which is inverse to the above is required, in which process, when the laterally moving body 23 is returned to the inside of the longitudinally moving body 4, the slide rail is also moved together with the laterally moving body 23 so as to be returned to the inside of the longitudinally moving body 4 because the connection between the laterally moving body 23 and the slide rail 24 is established by the operation of the connecting/releasing mechanism 60.

It is noted that when moving the care receiver C to a toilet 7, the same action as that for moving the care receiver to the wheelchair is applied, except that a sling for the toilet is used.

Although the invention has been described in its preferred embodiment, it is to be understood that the invention is not limited to the above embodiment but may be otherwise variously embodied within the scope of the invention.

EXPLANATION OF REFERENCE NUMERALS

C: Care receiver
1: Guide rail
2: Support
3: Base plate
4: Longitudinally moving body
5: Bed
9: Pla-rail chain
23: Laterally moving body
23G: Lifting drive mechanism
24: Slide rail
27, 29: Stopper
30: Roller
50: Projection regulating mechanism
60: Connecting/releasing mechanism

The invention claimed is:

1. A caring lift comprising:

first and second base plates, with one of said base plates arranged on a floor part at each of head and foot sides of a bed, respectively, said caring lift configured to selectively provide support for a care receiver;

a pair of spaced-apart brackets provided on each of the first and second base plates, each of said brackets having a hollow opening formed therein facing upwardly;

four supports erected on said base plates through said brackets in the vicinity of four corners of said bed;

a pair of guide rails supported above the bed by the four supports and arranged in parallel along both long-sides of said bed in planar view;

a longitudinally movable body, arranged between the pair of guide rails and capable of being moved in a longitudinal direction of the bed while being guided by the pair of guide rails;

a slide rail which is operatively attached to the longitudinally movable body for concurrent longitudinal movement therewith, the slide rail being slidably movable in a lateral direction of the bed relative to the longitudinally movable body, and capable of being selectively protruded outward from said longitudinally movable body laterally outside of one of said guide rails;

a laterally movable body attached movably in the lateral direction of the bed relative to the slide rail; and a lifting drive mechanism attached to the laterally movable body for selectively hanging down the care receiver, said lifting drive mechanism having a worm reduction gear with a self-lock function, wherein a wiring for supplying power to said lifting drive mechanism is arranged through a pla-rail chain arranged at said guide rail while permitting the wiring to be inserted in a pipe which constitutes said support.

2. The caring lift according to claim 1, wherein said slide rail is supported by at least three rollers provided along the lateral direction of said longitudinally movable body, while a plurality of stoppers, for regulating an amount of protrusion of the slide rail, are provided between said slide rail and said longitudinally movable body, thereby allowing said slide rail to be supported by at least two rollers out of at least said three rollers when the plurality of stoppers are in operation.

3. The caring lift according to claim 1, wherein a length of each of said base plates, with respect to the lateral direction of said bed, is made larger than a spacing between said pair of guide rails.

4. The caring lift according to claim 1, further comprising:

a protrusion regulating mechanism having a regulating member which selectively takes a regulating position, for regulating protrusion of said slide rail from the longitudinally movable body, or a protrusion releasing position for permitting said protrusion; and a connecting/releasing mechanism for making a connection between said slide rail and said laterally movable body when said slide rail gets protruded from the longitudinally movable body, while releasing the connection between said slide rail and said laterally movable body when said regulating member is placed at the regulating position.

5. The caring lift according to claim 2, wherein a length of each of said base plates, with respect to the lateral direction of said bed, is made larger than a spacing between said pair of guide rails.

6. The caring lift according to claim 2, further comprising:

a protrusion regulating mechanism having a regulating member which selectively takes a regulating position, for regulating protrusion of said slide rail from the longitudinally movable body, or a protrusion releasing position for permitting said protrusion; and a connecting/releasing mechanism for making a connection between said slide rail and said laterally movable body when said slide rail gets protruded from the longitudinally movable body, while releasing the connection between said slide rail and said laterally movable body when said regulating member is placed at the regulating position.

7. The caring lift according to claim 3, further comprising:

a protrusion regulating mechanism having a regulating member which selectively takes a regulating position, for regulating protrusion of said slide rail from the longitudinally movable body, or a protrusion releasing position for permitting said protrusion; and a connecting/releasing mechanism for making a connection between said slide rail and said laterally movable body when said slide rail gets protruded from the longitudinally movable body, while releasing the connection between said slide rail and said laterally movable body when said regulating member is placed at the regulating position.

* * * * *